US006428365B1

(12) United States Patent
Yamamoto

(10) Patent No.: US 6,428,365 B1
(45) Date of Patent: Aug. 6, 2002

(54) TERMINAL

(75) Inventor: Hiroshi Yamamoto, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/594,813

(22) Filed: Jun. 16, 2000

(30) Foreign Application Priority Data

Jun. 17, 1999 (JP) ..... 11-171412

(51) Int. Cl.[7] ..... H01R 11/22

(52) U.S. Cl. ..... 439/849; 439/843; 439/852; 439/845

(58) Field of Search ..... 439/849, 852, 439/850, 854, 862, 851, 876, 538, 578, 610, 585, 843, 845

(56) References Cited

U.S. PATENT DOCUMENTS

| | | | | |
|---|---|---|---|---|
| 5,601,458 A | | 2/1997 | Ohsumi et al. | |
| 5,722,925 A | * | 3/1998 | Kameyama et al. | 439/849 |
| 6,039,615 A | * | 3/2000 | Suzuki | 439/849 |
| 6,095,873 A | | 8/2000 | Muramatsu et al. | |
| 6,116,970 A | * | 9/2000 | Yamamoto et al. | 439/852 |

FOREIGN PATENT DOCUMENTS

| | | | |
|---|---|---|---|
| JP | 3-77382 | * | 8/1991 |
| JP | 7-42005 | | 7/1995 |
| JP | 07181277 | | 7/1995 |
| JP | 9-35796 | * | 2/1997 |
| JP | 11-260448 | | 9/1999 |

OTHER PUBLICATIONS

09/575,647, Hiroshi Yamamoto, May 31, 2000.

* cited by examiner

*Primary Examiner*—Tho D. Ta
*Assistant Examiner*—Phuong Chi Nguyen
(74) *Attorney, Agent, or Firm*—Finnegan, Henderson, Farabow, Garrett, & Dunner, L.L.P.

(57) ABSTRACT

A terminal has a bottom wall, a pair of side walls, an upper wall, an elastic contact portion that is freely elastically deformable in a direction substantially vertical with respect to the bottom wall, an elastic receiving surface portion that opposes the elastic contact portion, an excessive-displacement-preventing piece, and a deformation-preventing stopper. The side walls respectively rise from both ends of the bottom wall. The upper wall extends from at least one of the side walls to over the bottom wall and opposes the bottom wall. The elastic contact portion and the excessive-displacement-preventing piece are provided on one of the bottom wall and the upper wall while the elastic receiving surface portion is provided on the other of them. The excessive-displacement-preventing piece is situated in the vicinity of the elastic contact portion and come into contact with the elastic contact portion in order to prevent excessive displacement of the elastic contact portion. The deformation-preventing stopper is extended from at least one of the side walls. The deformation-preventing stopper is situated in the vicinity of the excessive-displacement-preventing piece in order to check the deformation thereof by contact therewith.

3 Claims, 4 Drawing Sheets

TERMINAL

BACKGROUND OF THE INVENTION

1. Field of the Invention

The present invention relates to a terminal that prevents excessive displacement of an elastic contact portion due to the distortion of a mating terminal, etc.

2. Description of the Related Art

A conventional female terminal that is disclosed in Japanese Utility Model Application Laid-Open No. 7-42005 is equipped with a bottom wall, a pair of side walls that have been substantially vertically bent from the bottom wall, and upper walls that have been bent from upper ends of the side walls so as to become parallel with the bottom wall. A part of the bottom wall is bent to form an elastic contact portion while a part of the upper wall is bent to form an elastic receiving surface portion opposing the elastic contact portion. A part of the bottom wall is raised by cutting to thereby form an excessive-displacement-preventing piece, an upper end of that is situated in the vicinity of a bottom surface of the elastic contact portion. On both sides of an upper end of the excessive-displacement-preventing piece there are respectively provided protruding portions, that are inserted into holes respectively formed in the side walls.

When a male terminal is inserted into between the elastic contact portion and the elastic receiving surface portion, the elastic contact portion is elastically deformed. As a result of this, the insertion of the male terminal is permitted. And the male terminal come. into contact with the elastic contact portion and the elastic receiving surface portion under a prescribed level of pressure. When the male terminal is inserted from an inappropriate direction and as a result the elastic contact portion has received a load resulting from a distortion, etc., the excessive-displacement-preventing piece comes into contact with the elastic contact portion to thereby prevent excessive displacement thereof.

SUMMARY OF THE INVENTION

However, in the above-described terminal, in order to increase the strength of the excessive-displacement-preventing piece, the protruding portions are inserted in the holes of the side walls. Accordingly, precise working is needed to be done so that the protruding portions and the holes may positionally coincide with each other. Simultaneously, a complex operation of inserting the protruding portions into the holes is needed to be performed. This adversely affects the productivity.

Also, the terminal is of a structure wherein the load from the elastic contact portion is received by the protruding portions of the excessive-displacement-preventing piece. And the load is input along the thickness direction of the protrusion. Therefore, when having received an excessive load, the protruding portion is deformed with the result that there is the possibility that excessive displacement will not be prevented.

Thereupon, an object of the present invention is to provide a terminal that is easy to manufacture and enables reliably preventing the elastic contact portion from being excessively displaced.

To achieve the above object, a terminal according to the present invention has a bottom wall, a pair of side walls, an upper wall, an elastic contact portion that is freely elastically deformable in a direction substantially vertical with respect to the bottom wall, an elastic receiving surface portion that opposes the elastic contact portion, an excessive-displacement-preventing piece, and a deformation-preventing stopper. The side walls respectively rise from both ends of the bottom wall. The upper wall extends from at least one of the side walls to over the bottom wall and opposes the bottom wall. The elastic contact portion and the excessive-displacement-preventing piece are arranged on one of the bottom wall and the upper wall while the elastic receiving surface portion is arranged on the other of them. The excessive-displacement-preventing piece is close to the elastic contact portion and comes into contact with the elastic contact portion to prevent excessive displacement of the elastic contact portion. The deformation-preventing stopper is extended from at least one of the side walls. The deformation-preventing stopper comes into contact with the excessive-displacement-preventing piece to prevent deformation thereof. To this end, the deformation-preventing stopper is disposed close to the excessive-displacement-preventing piece.

According to this construction, when the amount of deformation of the elastic contact portion that has received the load reaches a prescribed value, the elastic contact portion contacts with the excessive-displacement-preventing piece, whereby any further deformation of the excessive-displacement-preventing piece is prevented. In this condition, when the load applied to the elastic contact portion increases, the excessive-displacement-preventing piece comes into contact with the deformation-preventing stopper, whereby this stopper prevents the deformation of the excessive-displacement-preventing piece. Since the deformation-preventing stopper is only needed to be so provided from the side wall as to exist near the excessive-displacement-preventing piece, it is possible to manufacture the terminal easily. In addition, it is also possible to prevent the excessive displacement of the elastic contact portion.

An end surface of the deformation-preventing stopper may come into contact with the excessive-displacement-preventing piece to prevent deformation thereof. And the width of the deformation-preventing stopper may be greater than the thickness thereof.

According to this construction, in the deformation-preventing stopper, the direction in that the load is applied from the excessive-displacement-preventing stopper coincides with the width direction of the deformation-preventing stopper. As a result of this, the deformation-preventing stopper receives the load with its width dimension greater than its thickness dimension. Therefore, the deformation-preventing stopper does not deform even with respect to the load in excess and so can prevent excessive displacement of the elastic contact portion even with respect thereto.

DESCRIPTION OF THE PREFERRED EMBODIMENTS

An embodiment of the present invention will now be explained with reference to the drawings.

Figure 1:
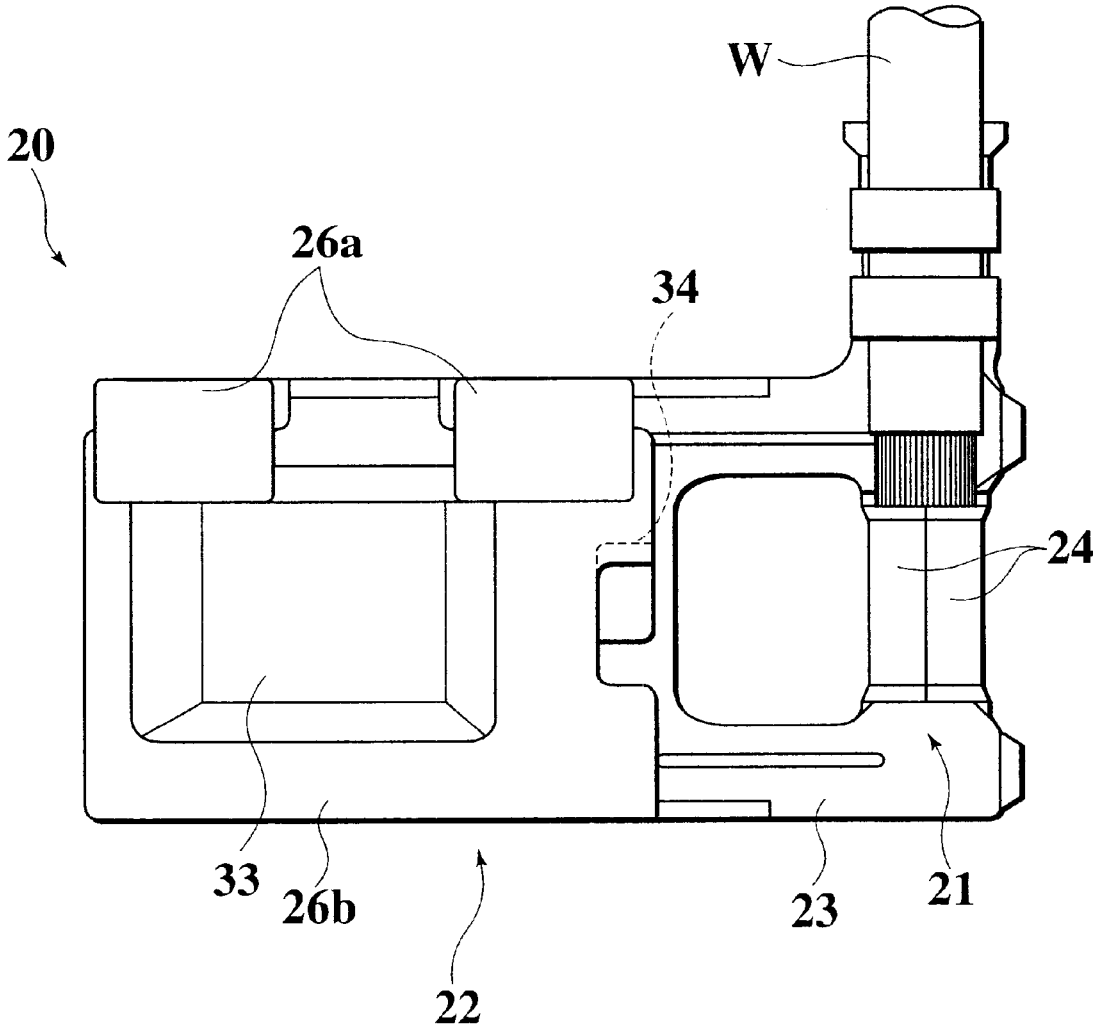
FIG. 1 is a plan view illustrating a female terminal according to an embodiment of the present invention.
Figure 2:
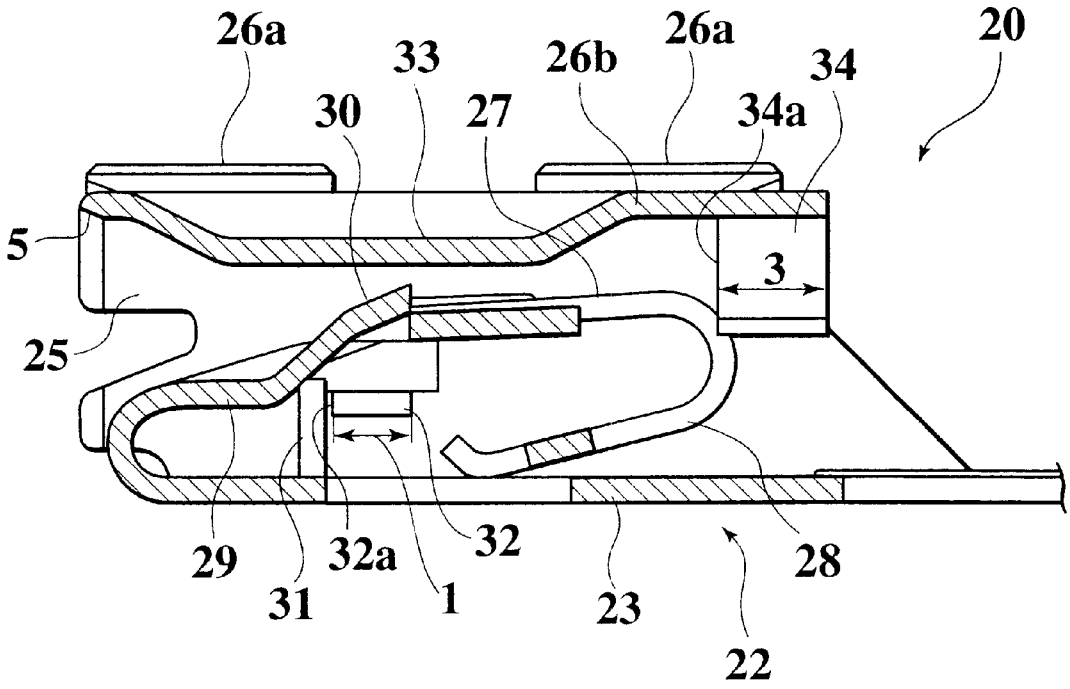
FIG. 2 is a sectional view illustrating the female terminal of FIG. 1.
Figure 3:
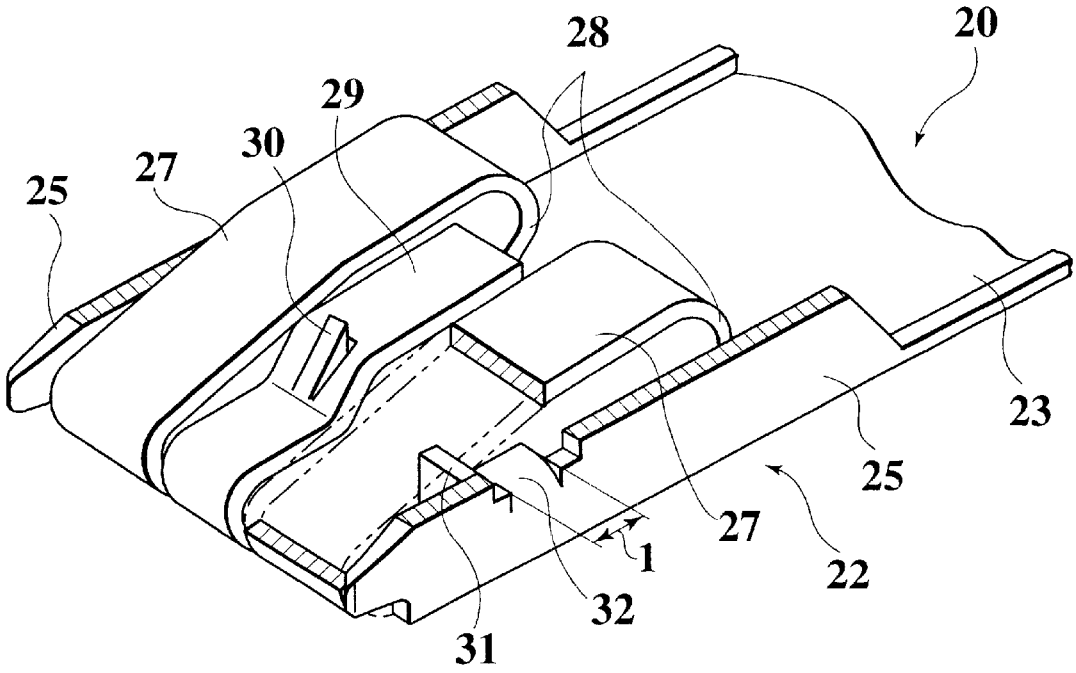
FIG. 3 is a perspective view illustrating a main part of the female terminal of FIG. 1.
Figure 4:
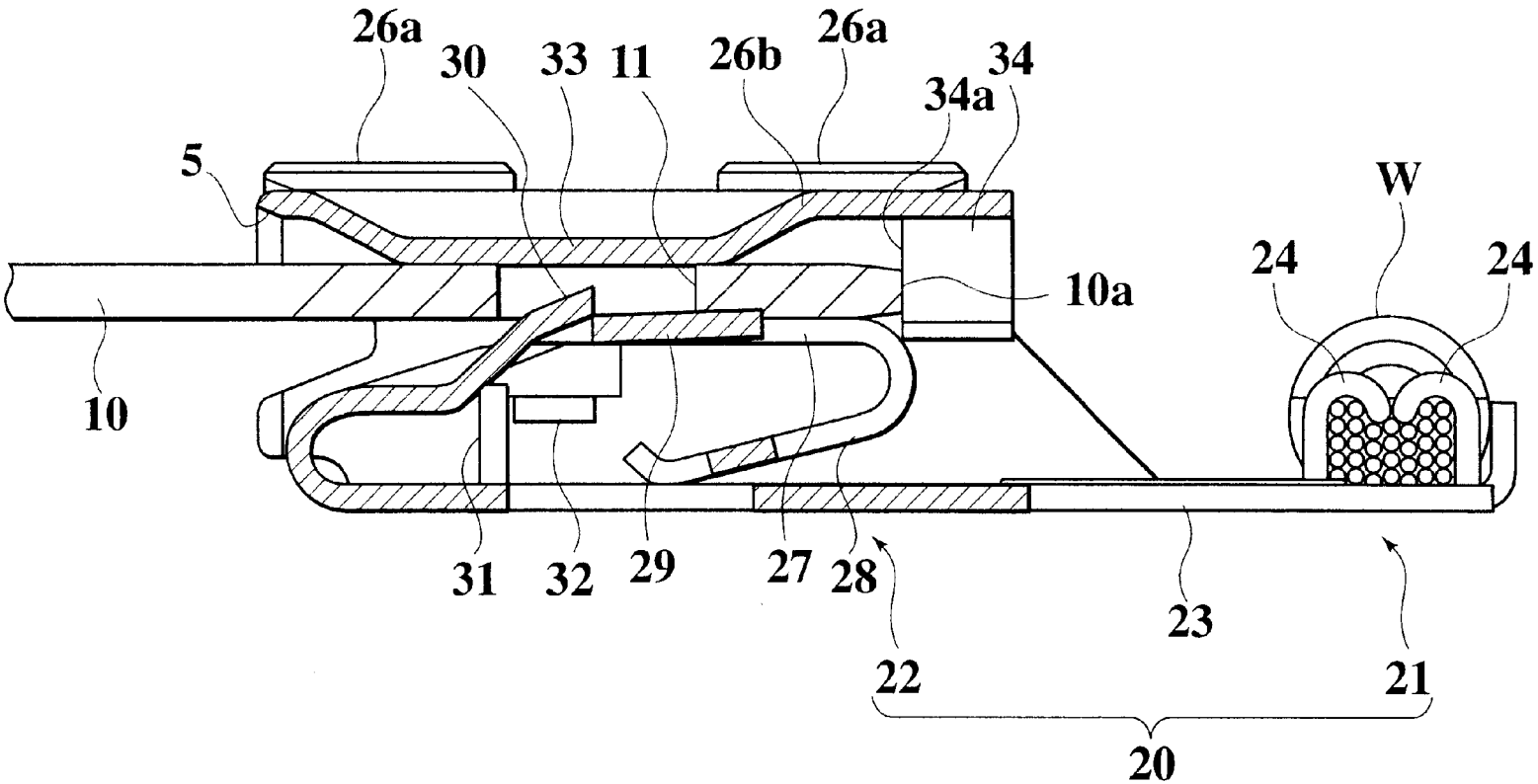
FIG. 4 is a sectional view illustrating a state where a male terminal has been inserted into the female terminal of FIG. 1.

FIGS. 1 to 4 illustrate an embodiment of the present invention. FIG. 1 is a plan view of a female terminal; FIG. 2 is a sectional view thereof; FIG. 3 is a perspective view illustrating a main part of the female terminal; and FIG. 4 is a sectional view illustrating a state where a male terminal has been inserted into the female terminal.

In FIGS. 1 through 4, the female terminal 20 is integrally formed by being punched out from a single metal flat plate, and the female terminal 20 has an electric-wire-fastening portion 21 and a terminal contact portion 22. The electric-wire-fastening portion 21 has a bottom wall 23 and a pair of caulking pieces 24 that have been upwardly bent from each end of the bottom wall 23. An electric wire W that has been placed between a pair of the caulking pieces 24 is fastened by a pair of the caulking pieces 24.

The terminal contact portion 22 has a bottom wall 23 common to that of the electric-wire-fastening portion 21, a pair of side walls 25 substantially vertically bent from both ends of the bottom wall 23 respectively, and upper walls 26*a* and 26*b* respectively bent from upper ends of the side walls 25 to over the bottom wall 23.

On the bottom wall 23 there are provided three divided forward protruding portions. The both-side forward protruding portions of these protruding portions are bent in such a way as to overlap the bottom wall 23 from over the same with some suitable space remaining therebetween. And as a result of this a pair of elastic contact portions 27 are constructed. A rear side of each elastic contact portion 27 is further bent in such a way as to enter into over the bottom wall 23, whereby an elastic reinforcing portion 28 is constructed. When the elastic contact portion 27 is downwardly displaced to some extent, that elastic reinforcing portion 28 abuts on the bottom wall 23, whereby the reinforcing portion 28 itself also is elastically deformed. By this elastic deformation, the reinforcing portion 28 elastically reinforces the contact portion 27.

Also, a central forward protruding portion is bent in such a way as to overlap the bottom wall 23 from over the same with some suitable space remaining therebetween, too, whereby a central elastic-deformation portion 29 is constructed. On this central elastic-deformation portion 29 there is formed an engaging/retaining protruding portion 30 constituting an engaging/retaining portion by the portion 29 being partly bent. The engaging/retaining protruding portion 30 protrudes upward and is vertically displaced with elastic deformation of the central elastic-deformation portion 29. On a rear side of the central elastic-deformation portion 29 there is not provided an elastic reinforcing portion 28 such as that provided with respect to the elastic contact portion 27. As a result of this, the central elastic-deformation portion 29 is constructed so that this portion 29 may be subjected to easy, downward, elastic deformation.

Further, on the left and right sides of the bottom wall 23 there are respectively provided excessive-displacement-preventing piece portions 31 that are bent substantially in the vertical direction and that extend upward. Upper ends of this pair of excessive-displacement-preventing piece portions 31 are respectively situated in the vicinities of the undersides of forward portions of a pair of the elastic contact portions 27.

On a pair of side walls 25 there are respectively provided deformation-preventing stoppers 32, by raising parts of the side walls 25, that are bent in directions each intersecting its corresponding side wall substantially at a right angle with respect thereto (the directions orthogonally intersecting the directions in that the male terminal 10 is inserted) and that horizontally extend. Frontward end surfaces 32*a* of this pair of deformation-preventing stoppers 32 are respectively disposed in such a way as to substantially abut on the rear surfaces of upper end portions of a pair of the excessive-displacement-preventing pieces 31 (the surfaces as viewed on the upstream side in the direction in that the terminal is inserted). The width dimension 1 of each deformation-preventing stopper 32 is set to be sufficiently larger than the thickness dimension thereof.

Two upper walls 26*a* and 26*b* on both sides are disposed in such a way as to partly overlap each other, and the upper-side upper wall 26*a* regulates the upward displacement of the lower-side upper wall 26*b*. The lower-side upper wall 26*b* is partly bent downward to provide an elastic receiving surface portion 33. This elastic receiving surface portion 33 opposes the elastic contact portions 27 of the bottom wall 23. Also, on the lower-side upper wall 26*b* there is provided a stopper 34 that is bent downward and that is vertically extended. The stopper 34 is so disposed as for its end surface 34*a* to abut on a forward end surface 10 of the male terminal 34. The width dimension 3 (illustrated in FIG. 2) of the stopper 34 is set to be sufficiently larger than the thickness thereof.

On the other hand, the male terminal 10 (illustrated in FIG. 4) that is a mating terminal is shaped like a flat rod. At a position that is somewhat distant from a forward end thereof toward a base end side, there is formed an engaging/retaining hole 11 that is an engagement/retention portion to be engaged and retained.

In the above-described construction, when the male terminal 10 (illustrated in FIG. 4) that-is a mating terminal is inserted into between the elastic contact portion 27 and the elastic receiving surface portion 33, the elastic contact portion 27 and the central elastic-deformation portion 29 are elastically deformed downward. As a result of this, the insertion of the male terminal 10 is permitted. When the position of the engaging/retaining hole 11 of the male terminal 10 reaches the position of the engaging/retaining protruding portion 30 by insertion, this portion 30 is engaged with and retained by the engaging/retaining hole 11 of the male terminal 10 by the elasticity of the central elastic-deformation portion 29. As a result of this, the male terminal 10 and each of the elastic contact portion 27 and the elastic receiving surface 33 come into contact with each other under a prescribed level of pressure. Also, when the male terminal 10 is further inserted from this state, as illustrated in FIG. 4 the forward end 10*a* of the male terminal 10 abuts on the stopper 34. This keeps the male terminal 10 from its excessive insertion.

Also, when the elastic contact portion 27 receives a load as a result of a distortion, etc. by insertion of the male terminal 10 from an insertion direction that is not proper, etc., the elastic contact portion 27 is elastically deformed. When this elastic deformation reaches a prescribed amount of deformation, the elastic contact portion 27 abuts on the excessive-displacement-preventing piece 31. And the displacement of this excessive-displacement-preventing piece 31 being checked by the deformation-preventing stopper 32, that elastic contact portion 27 is prevented from being excessively displaced. Here, the deformation-preventing stopper 32 that checks the displacement of the excessive-displacement-preventing piece 31 is only needed to be so provided from its corresponding side wall 25 as to exist near to, and, at the back of, the excessive-displacement-preventing piece 31. Therefore, it is possible to manufacture the female terminal 20 without in the manufacturing process performing precise positional alignment or executing complex steps.

Also, in this embodiment, in the deformation-preventing stopper 32, the direction in that a load is applied thereto from the excessive-displacement-preventing piece 31 is in coincidence with the width direction of the deformation-preventing stopper 32. Accordingly, the deformation-preventing stopper 32 receives the load with its width dimension 1 larger than its thickness. Accordingly, the deformation-preventing stopper 32 does not deform even with respect to a load in excess. Accordingly, even with respect to a load in excess, the elastic contact portion 27 can be prevented from being excessively displaced.

Additionally, according to the above-described embodiment, the engagement/retention portion has been constituted as above by the engaging/retaining protruding portion 30 while the engagement/retention portion to be engaged and retained has been constituted as above by the engaging/retaining hole 11. However, if the relevant structures only enable the both terminals to be engaged and retained together when inserting the male terminal, the expected purpose can be accomplished.

Additionally, according to the above-described embodiment, on the bottom wall 23 there has been provided the elastic contact portion 27 while on the upper wall 26*b* there has been provided the elastic receiving surface portion 33. However, it may be arranged that the elastic receiving surface portion 33 be provided on the bottom wall 23 while the elastic contact portion 27 is provided on the upper wall 26*b*. In this case, the excessive-displacement-preventing piece 31 is provided on the upper wall 26*b*.

Additionally, according to the above-described embodiment, a pair of the elastic contact portions 27 and the central elastic-deformation portion 29 have been provided as above by being divided so that each of them can be separately independently deformed elastically. However, the both may be integrated together. In the former case where the -both have been provided in the divided way, however, the central elastic-deformation portion 29 is only needed to be elastically deformed when unlocking the engaging/retaining protruding portion 30 from the engaging/retaining hole 11. For this reason, the following merits exist. Namely, in this unlocking operation, there is no possibility of impairing the elasticity characteristic of a pair of the elastic contact portion 27 and therefore of obstructing the maintenance of a prescribed level of contact pressure. And in addition there also exists the following merit such as that attainable with the above-described embodiment. Namely, the elastic reinforcing portions 28 can be added to a pair of the elastic contact portions 27 to thereby provide a terminal that is excellent in terms of maintaining a prescribed level of contact pressure. Also, in a case where having integrally provided the elastic contact portion 27, the deformation-preventing stopper 32 may be provided only to one of the left and right side walls 25. However, in the case where having integrally provided the elastic contact portion 27, also, it is more preferable in terms of the mechanical strength to provide the deformation-preventing stopper 32 to each of the left and right side walls 25.

What is claimed is:

1. A terminal comprising:

a bottom wall;

a pair of side walls that respectively rise from both ends of the bottom wall;

an upper wall that extends from at least one of the side walls to over the bottom wall, the upper wall opposing the bottom wall;

an elastic contact portion that is freely elastically deformable in a direction substantially vertical with respect to the bottom wall, the elastic contact portion arranged on one of the bottom wall and the upper wall;

an elastic receiving surface portion that opposes the elastic contact portion, the elastic receiving surface portion being provided on the other of the bottom wall and the upper wall;

an excessive-displacement-preventing piece on said one of the bottom wall and the upper wall arranged close to the elastic contact portion, the excessive-displacement-preventing piece coming into contact with the elastic contact portion to prevent excessive displacement of the elastic contact portion; and a deformation-preventing stopper that is extended from at least one of the side walls, the deformation-preventing stopper arranged close to the excessive-displacement-preventing piece to prevent deformation thereof by contact therewith.

2. A terminal according to claim 1, further comprising:

an opening for receiving a mating terminal therethrough, the mating terminal being inserted from the opening into between the elastic contact portion and the elastic receiving surface portion, wherein the excessive-displacement-preventing piece is disposed between the opening and the deformation-preventing stopper.

3. A terminal according to claim 1, wherein an end surface of the deformation-preventing stopper comes into contact with the excessive-displacement-preventing piece to prevent deformation thereof; and a width of the deformation-preventing stopper is greater than a thickness thereof.

* * * * *